US008827744B2

(12) United States Patent
Poma et al.

(10) Patent No.: US 8,827,744 B2
(45) Date of Patent: Sep. 9, 2014

(54) WIRE CABLE ASSEMBLY

(75) Inventors: Eric B. Poma, Hubbard, OH (US); William J. Palm, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/428,435

(22) Filed: Mar. 23, 2012

(65) Prior Publication Data

US 2013/0029523 A1 Jan. 31, 2013

Related U.S. Application Data

(60) Provisional application No. 61/512,950, filed on Jul. 29, 2011.

(51) Int. Cl.
*H01R 9/05* (2006.01)

(52) U.S. Cl.
USPC ..... 439/585

(58) Field of Classification Search
USPC ..... 439/585, 882, 862, 852, 866; 174/84 C; 29/882, 867
See application file for complete search history.

(56) References Cited

U.S. PATENT DOCUMENTS

| | | | | |
|---|---|---|---|---|
| 2,904,619 | A * | 9/1959 | Forney, Jr. | 174/88 R |
| 3,828,305 | A * | 8/1974 | Hogendobler | 439/585 |
| 4,070,751 | A * | 1/1978 | Hogendobler et al. | 29/882 |
| 4,733,464 | A * | 3/1988 | Gregorac | 29/867 |
| 7,722,416 | B2 | 5/2010 | Gump et al. | |
| 2001/0002508 | A1 * | 6/2001 | Yamakawa | 29/753 |
| 2007/0155235 | A1 * | 7/2007 | De Keyser et al. | 439/585 |

FOREIGN PATENT DOCUMENTS

| | | |
|---|---|---|
| DE | 10343837 | 6/2005 |
| FR | 85118 | 6/1965 |
| JP | 2001257043 | 9/2001 |
| WO | 9854790 | 12/1998 |

OTHER PUBLICATIONS

European Search Report dated Oct. 18, 2012.

* cited by examiner

*Primary Examiner* — Alexander Gilman
(74) *Attorney, Agent, or Firm* — Robert J. Myers

(57) ABSTRACT

A wire cable assembly including a wire cable and a contact element. The contact element is configured to axially receive the wire cable and is formed to attach the wire cable to the contact element. A portion of the contact element is formed to define a single pair of indentation arrangements. The pair of indentation arrangements consists of a first indentation arrangement that diametrically opposes a second indentation arrangement. The contact element may also define a pair of humps adjacent to each of the grooves in the single pair of grooves. The wire cable may further include a conductive inner core, a first insulation layer surrounding the inner core, and an outer wire layer surrounding the first insulation layer. The wire cable assembly may further include an inner ferrule and an outer ferrule with the outer wire layer disposed between the inner ferrule and the outer ferrule.

11 Claims, 7 Drawing Sheets

WIRE CABLE ASSEMBLY

CROSS-REFERENCE TO RELATED APPLICATION

This application claims priority to provisional application U.S. Ser. No. 61/512,950 filed on Jul. 29, 2011.

TECHNICAL FIELD OF THE INVENTION

The invention generally relates to a wire cable assembly.

BACKGROUND OF THE INVENTION

Electrical contacts are commonly attached to wire cables by employing a crimp to form a crimp connection. In one such vehicle electrical application that employs a crimp connection (1) that uses shielded cable (4), it is desired to crimp the wire braid shielding to a ferrule so that electromagnetic energy absorbed by the wire braid shielding may be safely electrically drained. One common crimp used for this purpose is a hexagonal-shaped crimp (2). However, with this type of crimp, the ferrule and the wire braid shielding may extrude along seam in a manner that produces small outward protrusions (3) in the crimp connection where the tools of the press come together to produce the crimp connection. These small protrusions (3) may undesirably act as antennas to broadcast and/or receive radio frequency (RF) energy out from, or into the crimp connection (1) from electrical signals carried on the wire cables. If these protrusion antennas (3) broadcast RF energy in to the vehicle environment this may negatively affect operational performance of other electrical components in the vehicle. In contrast, if the protrusion antennas (3) undesirably receive RF energy, this may negatively affect the electrical signal transmission carried on the wire cable utilizing the ferrule. A corrupted electrical signal transmission carried on the wire cable may also cause unintended or faulty operation of electrical components that are electrically connected with the wire cable. Additionally, the need remains to improve the mechanical strength of the crimp connection attaching the electrical contact to the wire braid shielding or other portions of the wire cable while maintaining or improving the electrical integrity thereof.

What is needed is a robust wire assembly that contains a crimp connection that overcomes the abovementioned shortcomings.

BRIEF SUMMARY OF THE INVENTION

In accordance with one embodiment of the invention, a crimp connection a crimp connection includes a contact element and a wire cable. The wire cable is disposed along a longitudinal axis and configured to axially receive the contact element to form the crimp connection. When the crimp connection is formed that attaches the contact element with the wire cable, at least a portion of the crimp connection includes at least one indention arrangement that contains a pair of humps separated by a groove therebetween.

In another embodiment, a wire cable assembly includes at least a plurality of ferrules in which a crimp connection formed in the plurality of ferrules and attached to a wire cable includes at least a pair of humps separated by a groove therebetween.

In yet other embodiments, methods to construct a crimp connection in a wire cable assembly are also presented according to the invention that contain a pair of humps separated by a groove disposed therebetween.

Further features, uses and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

This invention will be further described with reference to the accompanying drawings in which.

DETAILED DESCRIPTION OF THE INVENTION

Wire assemblies may connect one electrical component with another electrical component in an electrical system application such as may be found in the motor transportation industry. One such wire assembly may be employed to connect an energy source and supply energy to a load in a motorized vehicle such as an electric or hybrid-electric vehicle. These wire assemblies may be also associated with wiring harnesses and electrical systems that are disposed in truck, airliners, and boats, and military vehicles.

Figure 2:
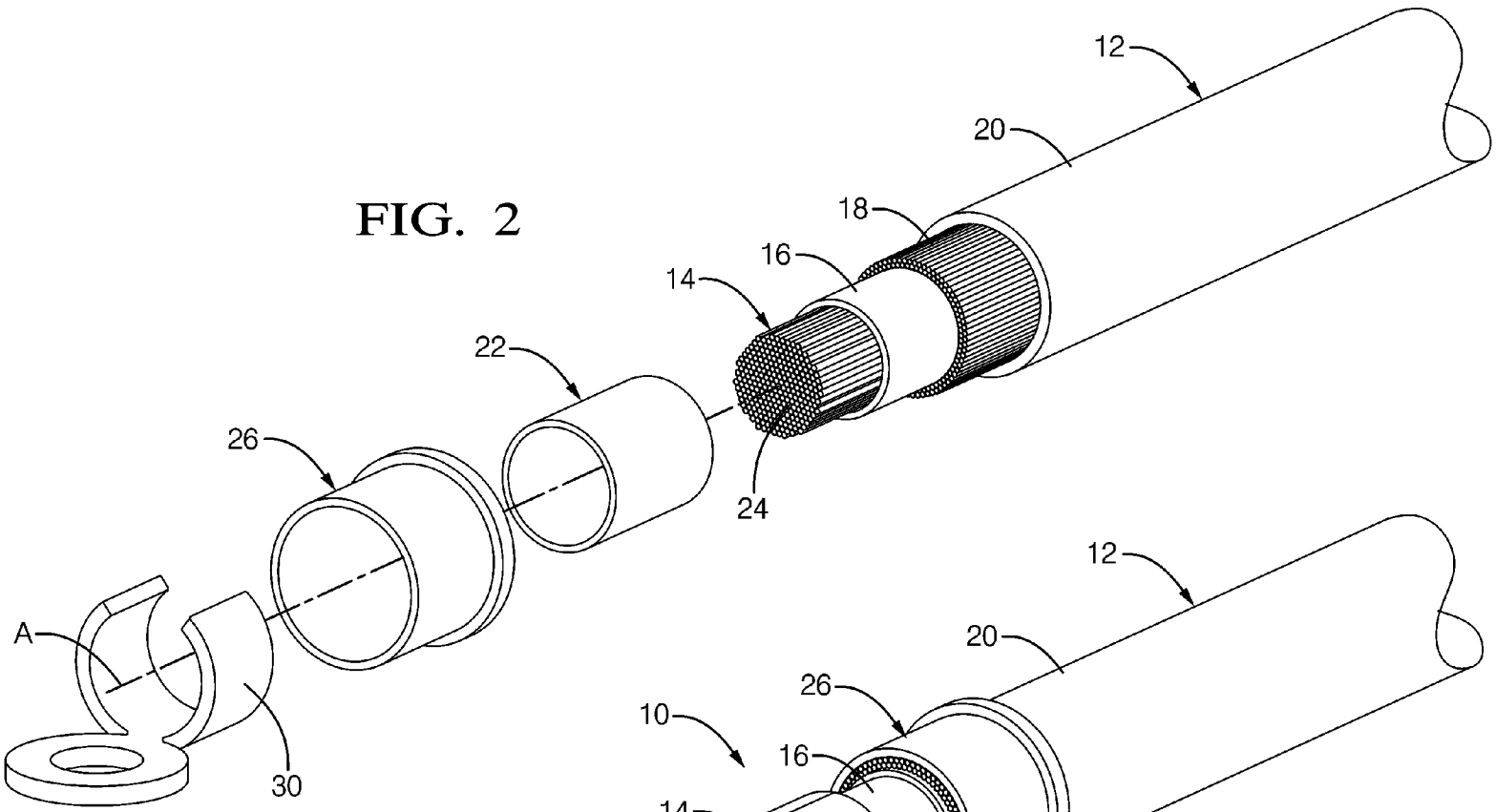
FIG. 2 shows an exploded view of the wire cable assembly according to the present invention.

Referring to FIG. 2, an exploded view of a wire cable assembly 10 according to the invention is presented. Wire cable assembly 10 includes a wire cable 12, a first inner electrically-conducting contact element, or inner ferrule 22, and a second outer electrically-conducting contact element, or outer ferrule 26. As used herein, an electrical contact may be defined as a device that is used to interconnect one electrical element with another electrical element, such as, for example, a terminal to a wire conductor or one or more ferrules to a wire conductor or a wire conductor assembly.

Inner and outer ferrules 22, 26 are preferably formed of a metallic material, such as steel or brass, and inner ferrule 22 has a smaller diameter than outer ferrule 26. Preferably, the wire cable 12 is formed from a copper or copper alloy material. Alternatively, the wire cable 12 may be formed from a metal material different from copper, such as aluminum.

Alternatively, at least one of the ferrules may be made from a dielectric, non-metallic material. The choice of using a metal ferrule for either the inner ferrule 22 or the outer ferrule 26 may reside in one that best provides electrical contact with a support structure that supports the wiring harness in a specific electrical application. Wire cable 12 is disposed along a longitudinal axis A and includes an inner core 14. Inner core 14 is surrounded by a first insulation layer 16. First insulation layer 16 underlies, and is surrounded by a wire braid layer 18. Wire braid layer 18 underlies and is surrounded by a second insulation layer 20. Wire braid layer 18 is formed of a layer of electrically-conductive material, for example, a conductive foil or a plurality of interlaced, individual wire strands or combinations thereof, as is understood in the electrical wiring arts.

Figure 3:
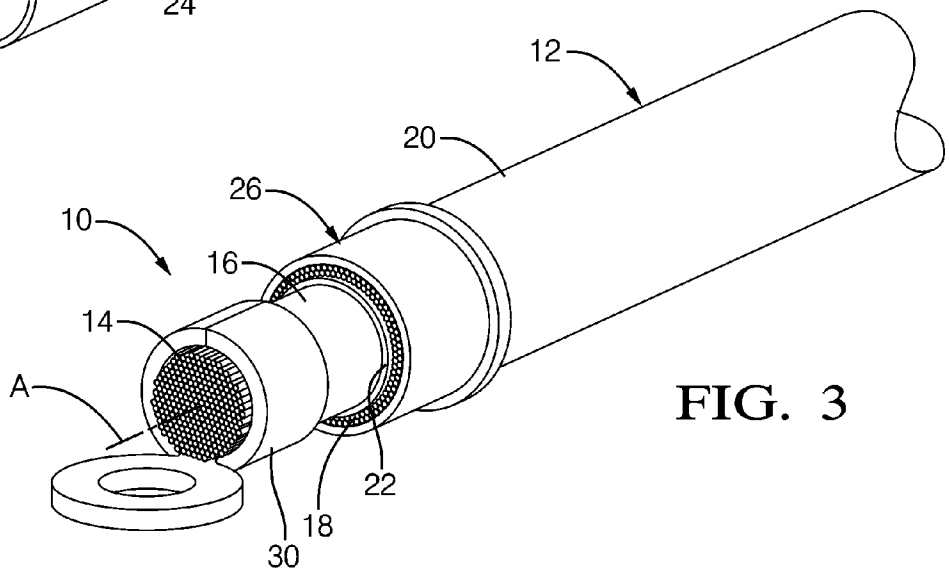
FIG. 3 shows the wire cable assembly of FIG. 2 when assembled together that does not include the crimp connection.

As shown in FIG. 3, inner and outer ferrules 22, 26 are assembled onto wire cable 12 by being axially received on wire cable 12. Termination lug 30 fits at an end 24 of wire cable 12 where end 24 is an exposed lead of inner core 14 of wire cable 12. Termination lug 30 may fasten to a bolt (not shown) associated with an electrical component in the vehicle. Alternatively, the termination lug may be any type of termination that is required to connect the wire cable assembly 10 to another wire harness or electrical component. Inner ferrule 22 fits on wire cable 12 to surroundingly overlie at least a portion of first insulation layer 16. Outer ferrule 26 is also configured for axial reception at end 24 of wire cable 12. Outer ferrule 26 overlies at least a portion of inner ferrule 22 such that wire braid layer 18 is surroundingly adjacently disposed between inner ferrule 22 and outer ferrule 26. As shown in FIG. 3, wire braid layer 18 is trimmed to a general length of at least one inner ferrule 22 when inner ferrule 22 is fitted on wire cable 12. Alternatively, the wire braid layer may be longer than a length of at least the inner ferrule 22 and bent back in a U-shape to overlie an external surface of the inner ferrule 22 so as to be disposed intermediate the inner and outer ferrules 22, 26.

Figure 4:
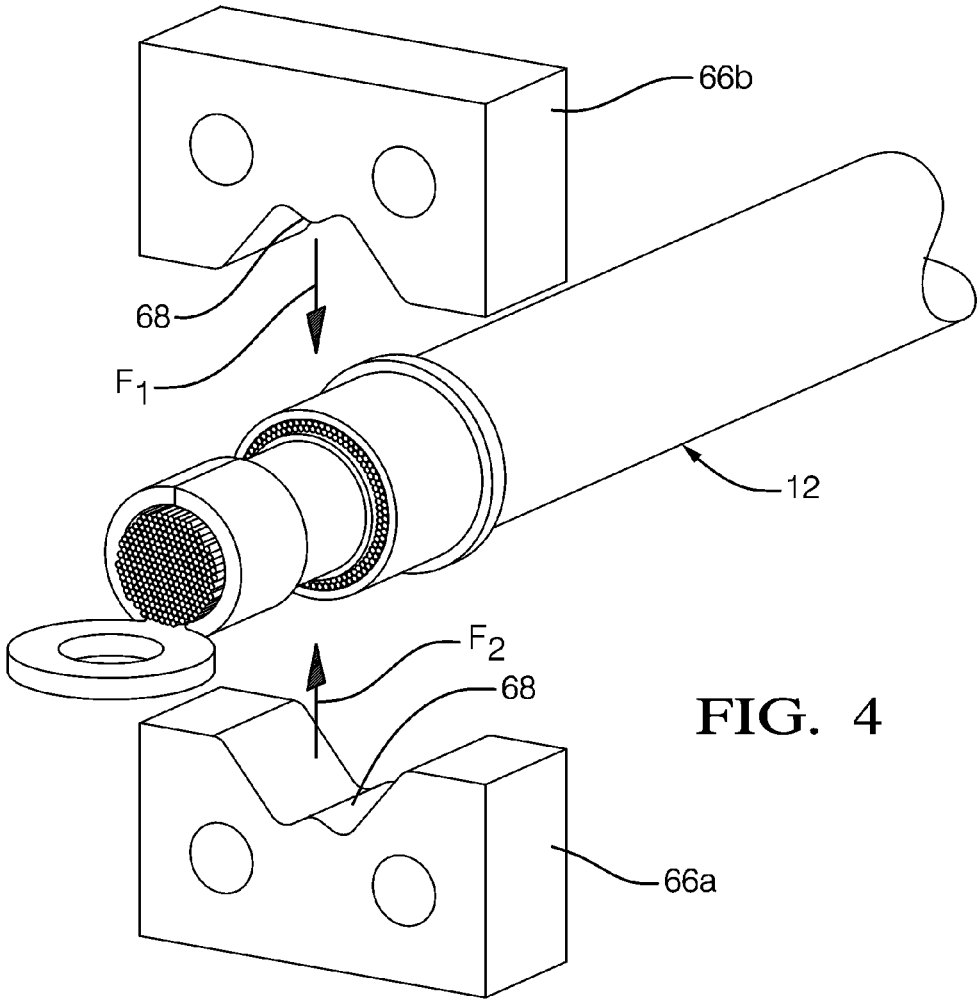
FIG. 4 shows the wire cable assembly of FIG. 3 being engaged by a crimp tool having at least one proboscis member.
Figure 5:
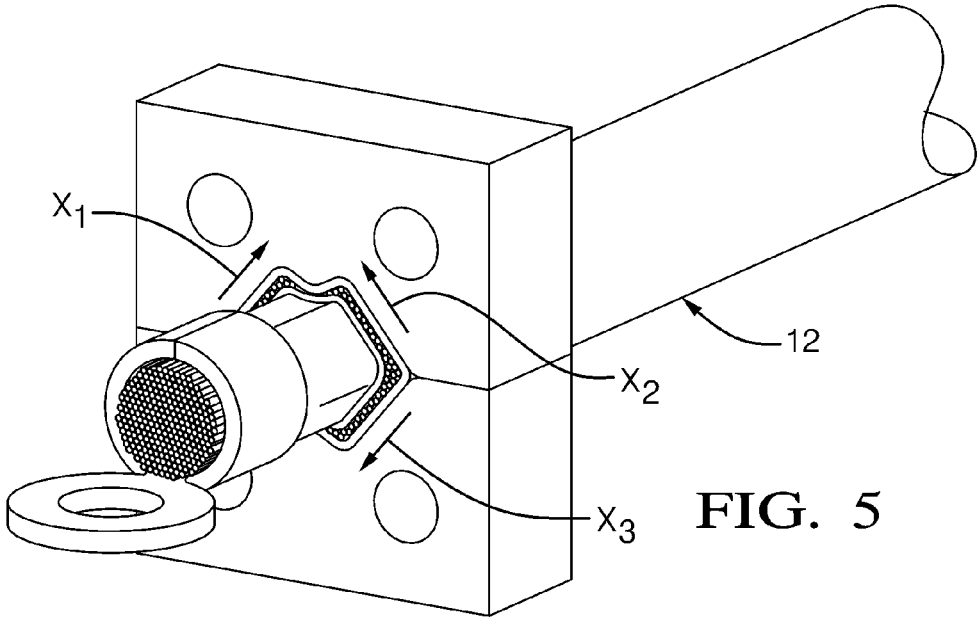
FIG. 5 shows the wire cable assembly of FIG. 4 engaged with the crimp tool to form a crimp connection.

Referring to FIGS. 4 and 5, when inner and outer ferrule 22, 26 are crimped together to wire cable 12 by a crimp tool assembly, or crimp tool 66, a crimp connection 28 is formed. Lower portion 66*a* and upper portion 66*b* of crimp tool 66 each converge towards each other and towards inner and outer ferrules 22, 26 and wire cable 12 to form crimp connection 28.

Figure 6:
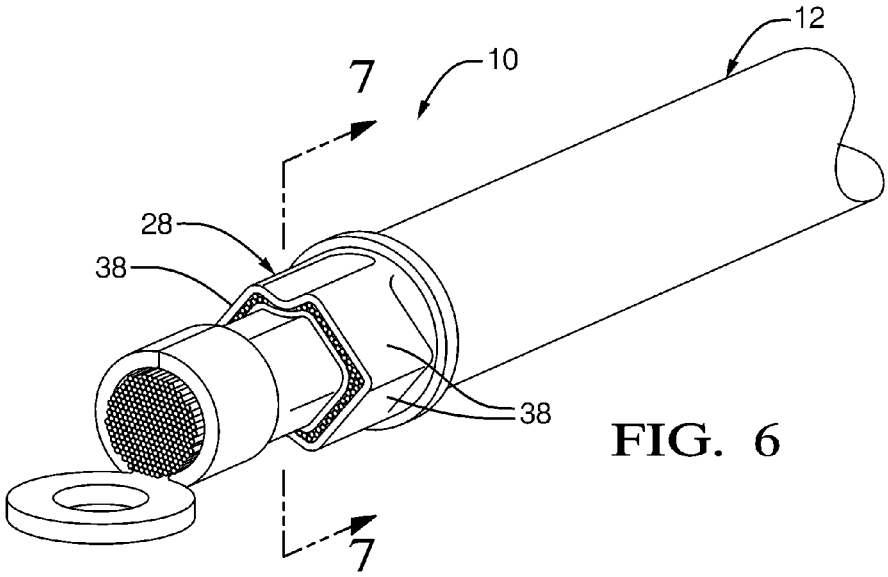
FIG. 6 shows the crimp connection of the wire cable assembly of FIG. 5, and details thereof.

Crimp connection 28 mechanically and electrically connects wire braid layer 18 to inner and outer ferrules 22, 26. Alternatively, the crimp connection may be used anywhere a coaxial cable-type wire cable assembly having shielded wire, or a wire braid layer is employed. The two portions, or halves of crimp tool 66 may be respectively fastened to a press (not shown), as is known in the wiring arts. The upper portion 66*b* of crimp tool 66 is defined as the plate 66*b* and a lower portion 66*a* of crimp tool 66 is defined as the anvil 66*a*. The upper and lower portions 66*a*, 66*b* of crimp tool 66 may be formed from a metal material such as hardened steel. The plate 66*b* and the anvil 66*a* of crimp tool 66 each define a proboscis member 68 and defined two humps with the proboscis member 68 separating the two humps. Crimp tool 66, along with proboscis member 68, under applied pressure supplied by the press, correspondingly forms first and second humps 46, 48 and first groove 54 in outer ferrule 26. The plate 66*b* of the crimp tool 66 is complementary constructed to that of the anvil 66*a* that similarly forms other humps and grooves similar to first and second humps 46, 48 in another opposing portion of outer ferrule 26, as previously described herein. Alternatively, not by way of limitation, depending on the amount of indention arrangements needed, other crimp tool configurations or combinations of crimp tool configurations may be utilized to construct the needed indention arrangement. Inner ferrule 22, as shown in FIG. 6, has a similar indention pattern than that of outer ferrule 26, but to a lesser extent where the indention pattern is less pronounced. Alternatively, the inner ferrule may not exhibit the indention pattern when the crimp connection is formed. Crimp connection 28 may be formed with a press that is manually operated by an assembly operator, or produced as part of an automated assembly manufacturing line. The force rating of the press required is dependent primarily on the wire gauge sizes of the wire cable being used and the type of crimp connection being formed.

Figure 7:
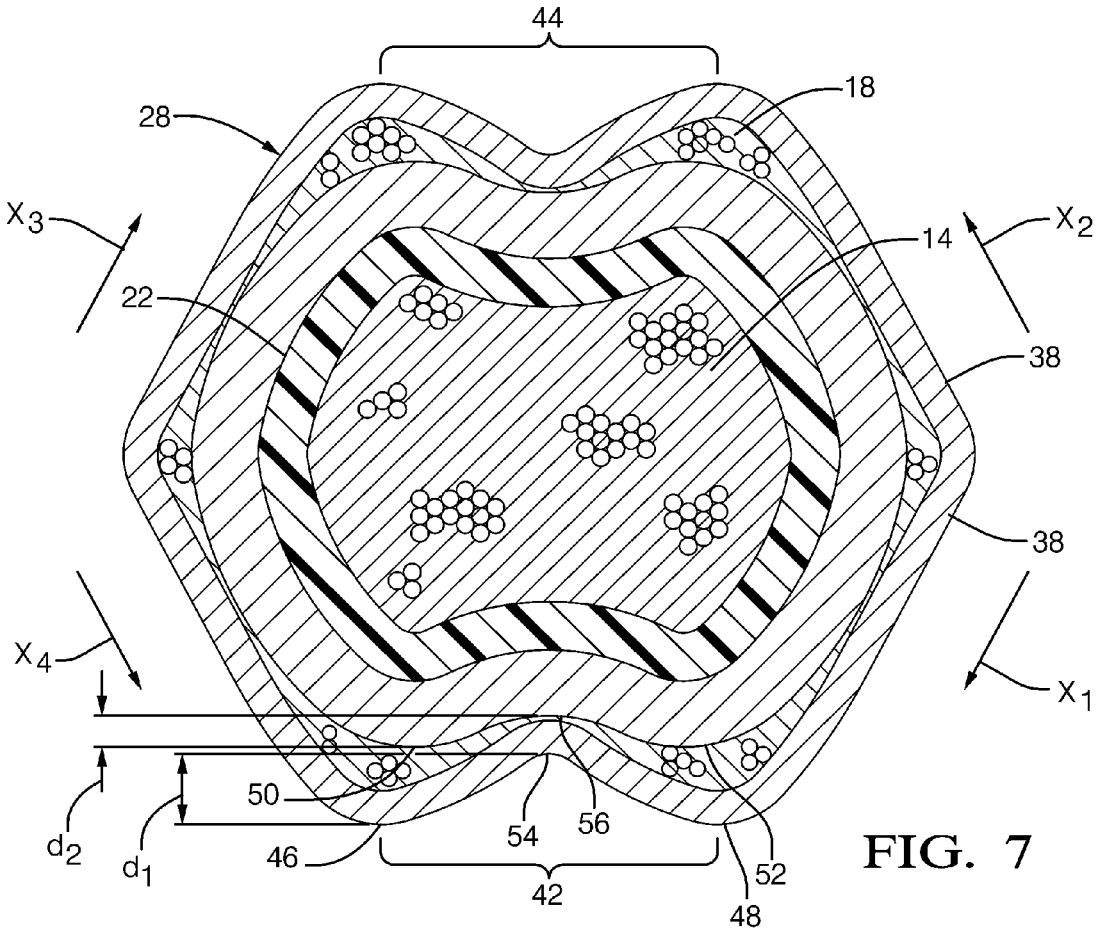
FIG. 7 shows a cross section of the crimp connection of FIG. 6 through the lines 7-7, and details thereof.

Referring to FIGS. 5-7, the anvil 66*a* and plate 66*b* each form a first and second indention arrangement 42, 44 in at least one outer ferrule 26 when crimp connection 28 is formed. Indention arrangement 42 is a first indention arrangement 42 and indention arrangement 44 is a second indention arrangement 44 that diametrically opposes first indention arrangement 42 across axis A. The first indention arrangement 42 of the anvil 66*a* forms a first hump 46 and a second hump 48 and the proboscis member 68 assists to form first valley, or first groove 54. First hump 46 is in communication with a second hump 48 transitioning through first groove 54, as best illustrated in FIG. 7. First and second indention arrangements 42, 44 have an indented shape that is different from the shape of other portions of outer ferrule 26 of crimp connection 28. The other portions of crimp connection 28 include a plurality of flat portions, or sides 38 similar to that of a hexagonal-shaped crimp connection. Alternatively, the sides, or any other portion of the crimp connection apart from the at least one indention arrangement, may be circular or any other type of shape that provides a robust crimp connection 28. The plate 66*b* forms an indention arrangement similar to that of the anvil 66*a*, as previously described herein. The second indention arrangement 44 formed by the plate 66*b* opposes the first indention arrangement 42 formed by the anvil 66*a*. Preferably, the first and second indention arrangements 42, 44 are formed in at least the outer ferrule 26 at a midpoint from where a seam is defined when the plate 66*b* and the anvil 66*a* of the crimp tool 66 engage to form crimp connection 28, as best seen in FIG. 5. While two indention arrangements are shown in FIGS. 5-7, alternatively, one indention feature may be employed. Still yet alternatively, more than two intention arrangements may be employed in the same crimp connection. The amount, or number of indention arrangements may depend on the wire gauge size of the wire cable, or wire cable assembly, being utilized.

Referring to FIG. 7, a cross section of crimp connection 28 is illustrated. First indention arrangement 42 includes a first, second, third and fourth hump 46, 48, 50, 52. First and second hump 46, 48 are formed in outer ferrule 26. Third and fourth hump 50, 52 are formed in inner ferrule 22. First hump 46 is adjacently proximate to third hump 50. Second hump 48 is adjacently proximate to fourth hump 52. Third and fourth humps 50, 52 are also formed when crimp connection 28 is constructed when the plate 66*b* and anvil 66*a* of crimp tool 66 meet. First, second, third and fourth humps 46, 48, 50, 52 and first and second grooves 54, 56 in crimp connection 28 are generally respectively formed in a direction that is perpendicular to axis A. With applied pressure from the press, crimp tool 66 including proboscis member 68 assists to form and deform outer ferrule 26 to form first groove 54 and first and second humps 46, 48. As first and second humps 46, 48 are constructed, third and fourth humps 50, 52 also deform, but to a lesser extent, as previously indicated herein. First groove 54 communicates with, yet separates first and second hump 46, 48. A second valley, or second groove 56, communicates with yet separates third and fourth hump 50, 52. Each of first and second grooves 54, 56 extends along a width and a length of the crimp connection 28 so as to have a concave arcuate shape that faces away from axis A. First, second, third and fourth humps 46, 48, 50, 52 respectively also have a concave arcuate shape that faces towards axis A. A depth $d_1$ as measured from first groove 54 to the crests of first and second hump 46, 48 is greater than a depth $d_2$ of a second valley, or second groove 56 to the crests of third and fourth hump 50, 52 of inner ferrule 22. When first, second, third and fourth humps 46, 48, 50, 52 are formed in crimp connection 28 with crimp tool 66, this allows material of inner and outer ferrules 22, 26 to be redistributed within crimp connection 28 where the upper and lower portion 66*a*, 66*b* of crimp tool 66 meet to prevent formation of the undesired antenna protrusions, as previously explained in the Background. This advantageously allows for a more uniform crimp connection 28 that is less susceptible to broadcast or receive RF energy when wire cable assembly 10 is disposed in an electrical application. First, second, third and fourth humps 46, 48, 50, 52 and first and second grooves 54, 56 combine to also provide a stronger mechanical attachment of wire braid layer 18 to inner and outer ferrules 22, 26 that may also provide an improved electrical connection of wire braid layer 18 with inner and outer ferrules 22, 26. Thus, second indention arrangement 44 is formed in a similar manner with similar features as first indention arrangement 42 that is previously discussed herein.

Alternatively, one of the pairs of humps may have deeper depth than the other one of the pairs of humps in relation to the first and second grooves. The humps and groove have a sufficient shape that allows the indention arrangement to be constructed without puncturing through the ferrule material which creates an undesirable defect. The depths between the groove and the crests of the humps may be chosen so as to have relation to a stock thickness of the ferrule material. Alternatively, the humps and groove may take on any shape so as to not cause the ferrule material to be punctured when the crimp connection is formed. Arcuate shapes void of sharp corners or edges are preferred and are found to be less likely to produce puncture of the ferrule material during formation of the crimp connection. If a contact element is punctured during crimp connection formation, this undesirably results in a quality defect.

Figure 8:
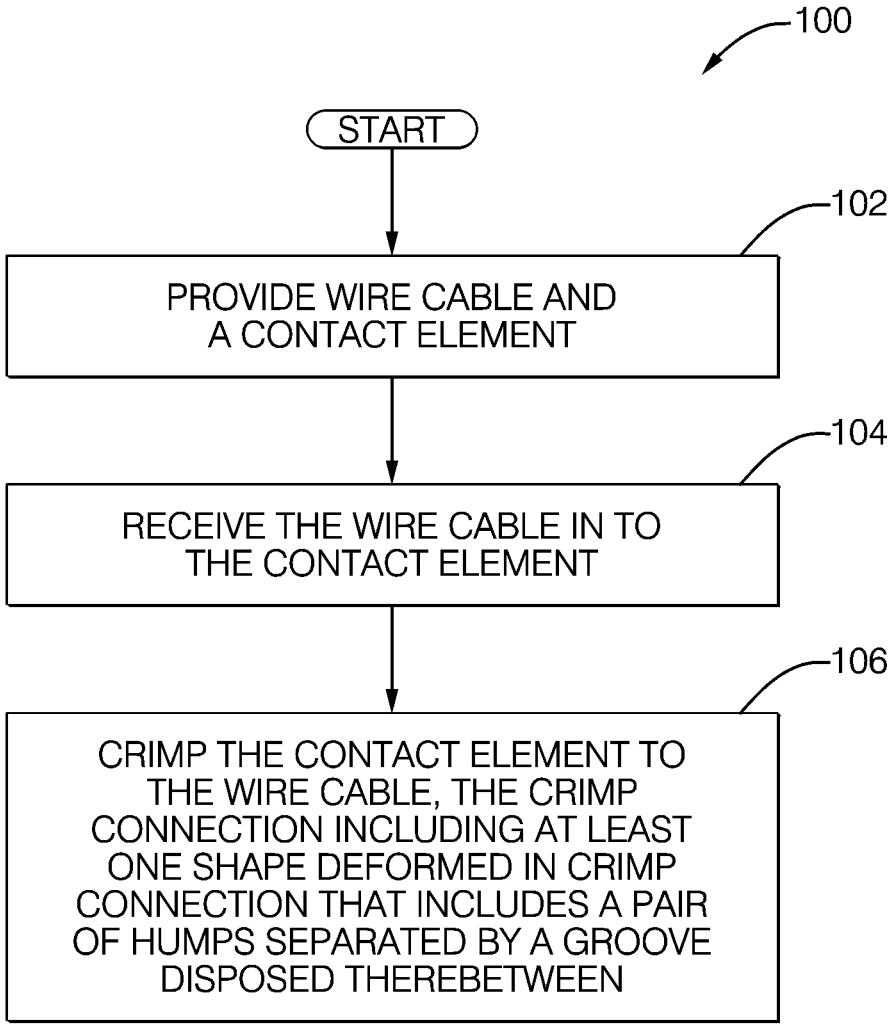
FIG. 8 shows a method flow diagram that illustrates how to construct a crimp connection of the wire cable assembly of FIGS. 2-7.

Referring to FIG. 8, a method 100 to construct crimp connection 28 is presented. One step 102 in method 100 is providing a wire cable 12 along a longitudinal axis A and at least one ferrule 22, 26. Another step 104 in method 100 is receiving the at least one ferrule 22, 26 by wire cable 12. In yet another step 106 of method 100 is crimping that at least one inner and outer ferrule 22, 26 together with wire cable 12 to form crimp connection 28 that attaches at least one ferrule 22, 26 to wire cable 12 where at least a portion of crimp connection 28 includes at least one of the first and second indention arrangement 42, 44 deformed in crimp connection 28 that includes a pair of first and second humps 46, 48 and first groove 54. Crimp connection 28 further enhances the mechanical strength and/or retention of wire cable 12 to inner and outer ferrules 22, 26 over a crimp connection that does not employ at least one of the first and second indention arrangements.

Without subscribing to any particular theory of operation, it may be appreciated that the outer ferrule 26 has a bore with an initial radius and the inner ferrule 22 has a bore with an initial radius that is smaller than the radius of the outer bore when initially receiving the end 24 of the wire cable 12. When the crimp connection 28 is formed, the radius of the inner and outer ferrules 22, 26 is substantially constrained by the converging upper and lower portions 66*a*, 66*b* of the crimp tool 66 assembly, or crimp tool 66, and may even decrease somewhat as the crimp connection 28 is formed. With increasing applied pressure from the converging crimp tool 66, the material of at least the outer ferrule 26 is forced to extrude in directions away from the applied pressure. As the proboscis members of the crimp tool 66 indent the outer ferrule 26 disposed at a location along the outer ferrule 26 intermediate the seam formed by the crimp tool 66 during crimp connection 28 formation, the indention allows the extruding material to move in a direction along the outer ferrule 26 away from the seam of the crimp tool 66 during formation of the crimp connection 28 so that outwardly extruded protrusions, or protrusion antennas disposed in proximity to the seam do not form. When the first and second grooves 54, 56 are formed in the outer ferrule 26, the first and second grooves 54, 56 have a nominal radius that is less than an initial radius of the outer ferrule 26 when the outer ferrule 26 is received by the wire cable 12 as shown in FIG. 2. The nominal radius of the first and second grooves 54, 56 is also less than a constrained nominal radius of the outer ferrule 26 when the upper and lower portions 66*a*, 66*b* of the crimp tool 66 converge together and apply a compressive pressure surroundingly against the outer ferrule 26, as best shown in FIG. 5. Thus, crimp connection 28 is controllably shaped in a manner to provide an increased perimeter of crimp connection 28 of the outer ferrule 26 over a perimeter of a similarly sized hexagonal crimp as discussed in the Background. As the material of outer ferrule 26 extrudes during crimp connection formation from the applied pressure, the material is routed to areas of crimp connection 28 that are more remotely located away from the proximity of the seam formed by engagement of the plate 66*b* and the anvil 66*a* of crimp tool 66. This ensures that the undesired protrusion antennas, as discussed in the Background, do not form when the crimp connection 206 is constructed.

Wire cable assembly 10 is not in use when wire cable 12 is not attached to inner and outer ferrules 22, 26 so that crimp connection 28 is formed. Wire cable assembly 10 is also not in use if termination lug 30 is not connected with wire cable 12. When not in use no electrical signal carried on wire cable 12 is transferred through inner and outer ferrules 22, 26 and termination lug 30.

Wire cable assembly 10 is in use when wire cable 12 is attached to inner and outer ferrules 22, 26 and crimp connection 28 is formed. Wire cable assembly 10 is also in use if termination lug 30 is connected with wire cable 12. When in use an electrical signal carried on wire cable 12 is transferred through attached inner and outer ferrules 22, 26 and attached termination lug 30.

Figure 9:
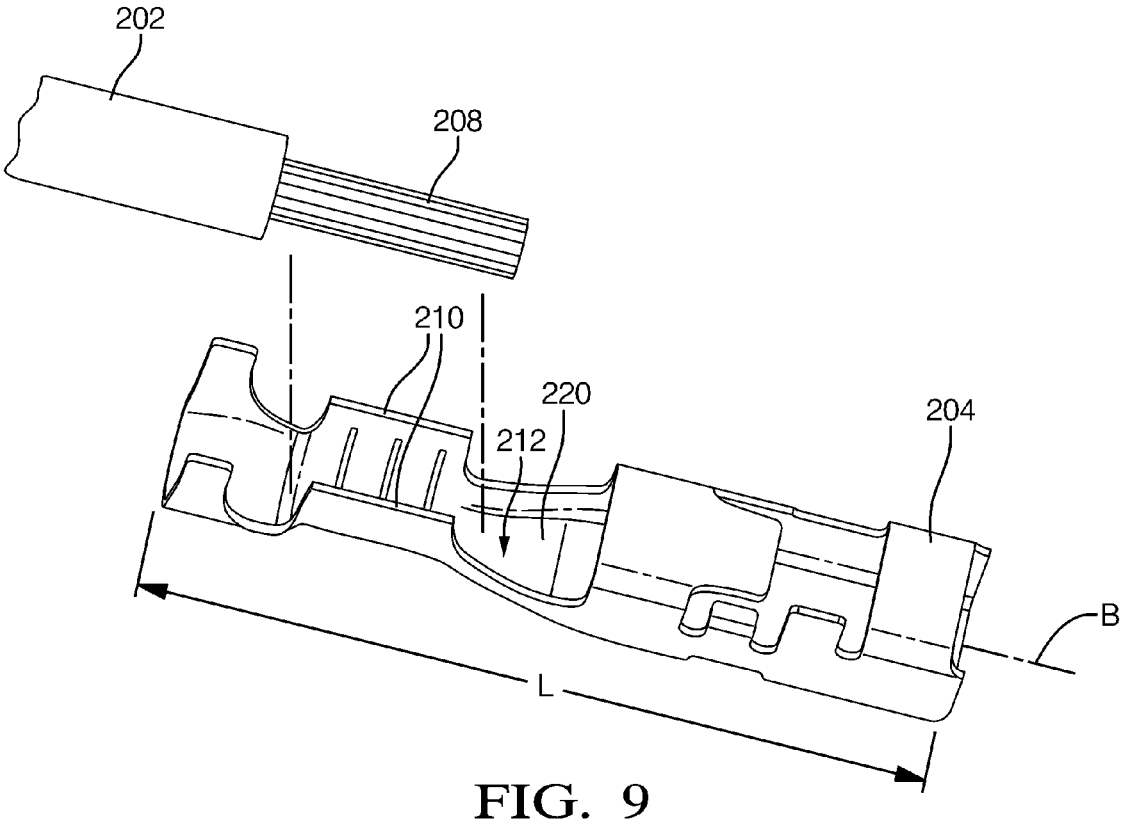
FIG. 9 shows a wire cable being received by a terminal to form a crimp connection thereon according to an alternative embodiment of the invention.
Figure 10:
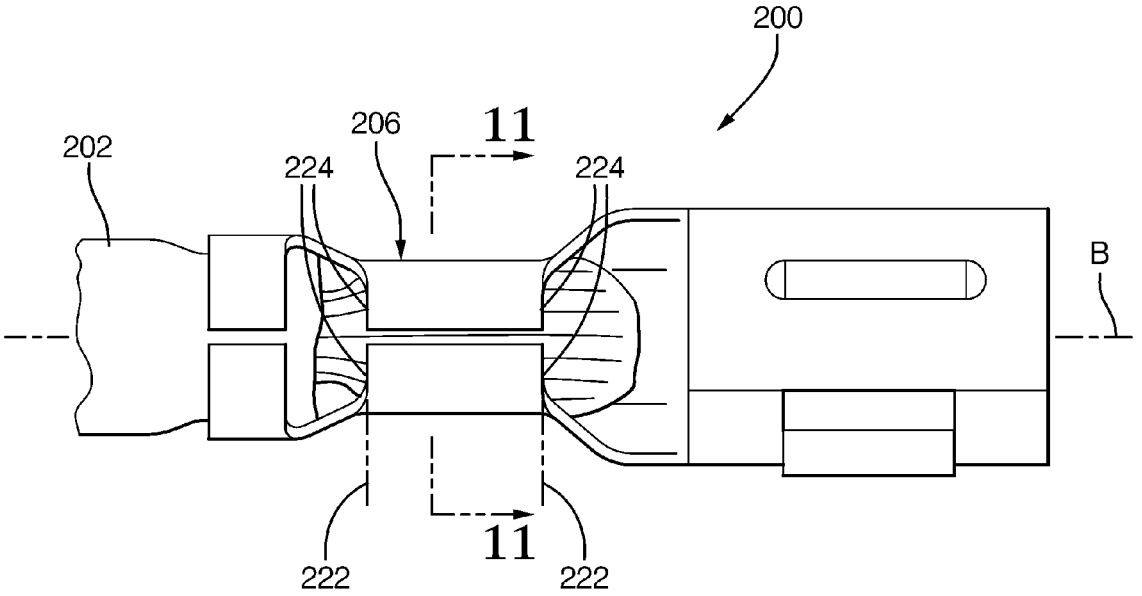
FIG. 10 shows the crimp connection formed between the wire cable and terminal of FIG. 9.
Figure 11:
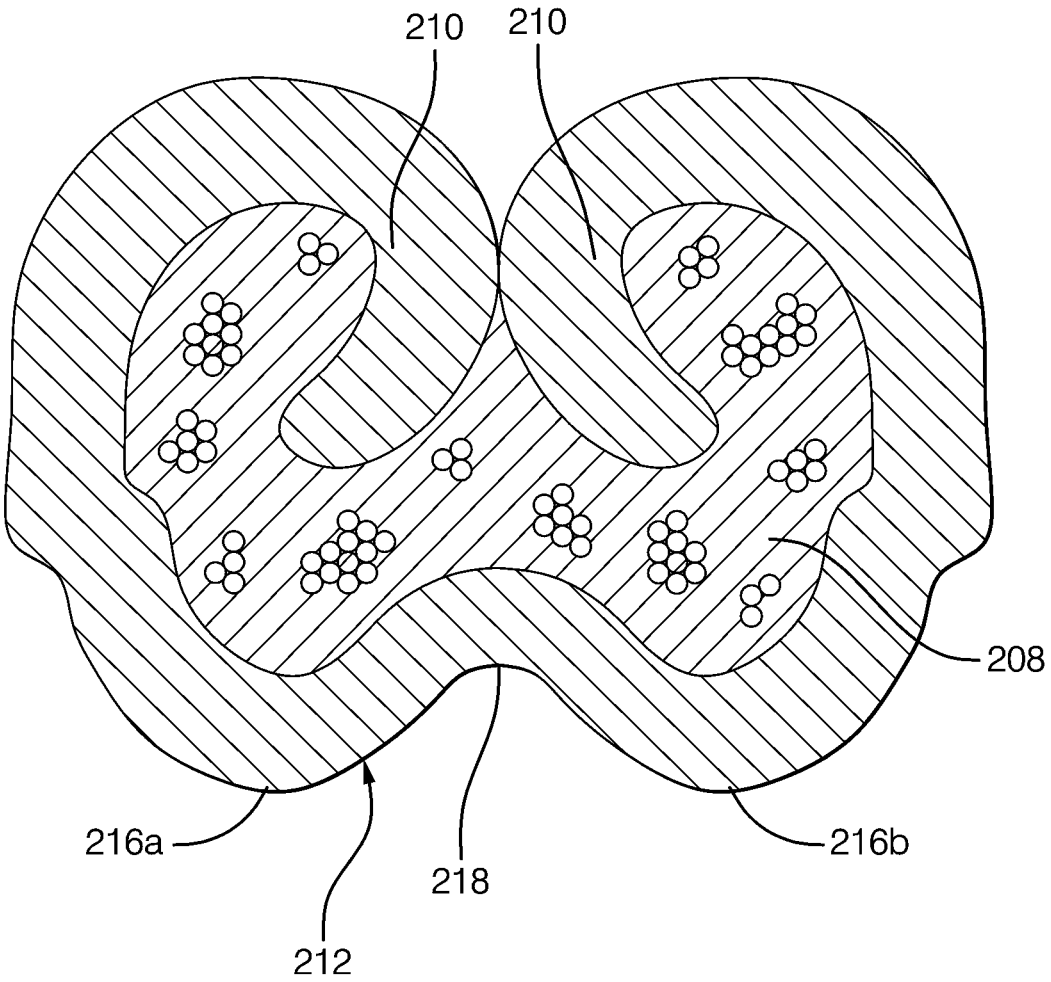
FIG. 11 shows the crimp connection of FIG. 10 where the base of the terminal includes a pair of humps separated by a groove therebetween.

Referring to FIGS. 9-11, according to an alternative embodiment of the invention, a wire assembly 200 includes a crimp connection 206 joins a wire cable 202 and a terminal 204 together. Terminal 204 has a length L disposed along a longitudinal axis B. A base 212 of terminal 204 is also axially disposed. A lead 208 of wire cable 202 is received in terminal 204 along axis B such that at least a portion of lead 208 is adjacent at least one core wing 210 and a floor 220 of terminal 204. When lead 208 is crimped to terminal 204 by a press, crimp connection 206 is formed. A crimp tool defines a proboscis member and a pair of humps, as previously described herein, and in conjunction with the press assists to form at least a first and second hump 216*a*, 216*b* separated by a valley, or groove 218 in base 212 when crimp connection 206 is formed.

Referring to FIG. 11, crimp connection 206 includes at least a first and second hump 216*a*, 216*b* and a groove 216 disposed therebetween. Preferably, a depth from groove 218 to the crests of first and second humps 216*a*, 216*b* is about the same depth. When both humps have a similar depth, this may advantageously allow for the terminal 204 to be more easily inserted and attached within a connector body that houses the wire assembly 200. Alternatively, each of the humps may have a different depth in relation to the groove. First and second humps 216*a*, 216*b* and groove 218 are respectively disposed in a direction along base 212 generally perpendicular to axis B. Preferably, the first hump 216*a* generally mirrors the second hump 216*b* across groove 218. First and second humps 216*a*, 216*b* respectively extend away in an outbound direction away from axis B relative to floor 220 of base 212. Planes 222 defined at respective axial edges 224 of at least one core wing 210 of crimp connection 206 extend down through base 212 of terminal 204 perpendicular to axis B. Preferably, at least a portion of the first and second humps 216*a*, 216*b* are disposed intermediate the respective planes 222. Crimp connection 206 further enhances the mechanical strength and/or retention of the wire cable 202 to terminal 204 over a crimp connection that does not employ the at least one hump and the groove.

Alternatively, the wire assembly that includes the indention arrangement may be utilized in any electrical application that requires wire braid shielding where radio wave frequencies and/or harmonic frequencies are desired to be mitigated.

Alternatively, more than one wire cable assembly may be utilized on a wiring harness disposed in the vehicle.

Still alternatively, a wire assembly may be constructed from three or more ferrules that are formed in to a crimp connection with a wire cable in which the crimp connection at least includes a pair of humps with a groove disposed therebetween as has been previously similarly been discussed herein.

In another alternative embodiment, the terminal lug in the embodiment as illustrated in FIG. 2 may have the crimp connection 206 as described in the embodiment as illustrated in FIGS. 9-11.

Still yet alternatively, for other wire assemblies the inner ferrule may have a physical size that is larger than the physical size of the outer ferrule in contrast to the physical sizes of the inner and the outer ferrule as illustrated in the embodiment of FIG. 2 and yet still be within the spirit and the scope of the invention.

Figure 1:
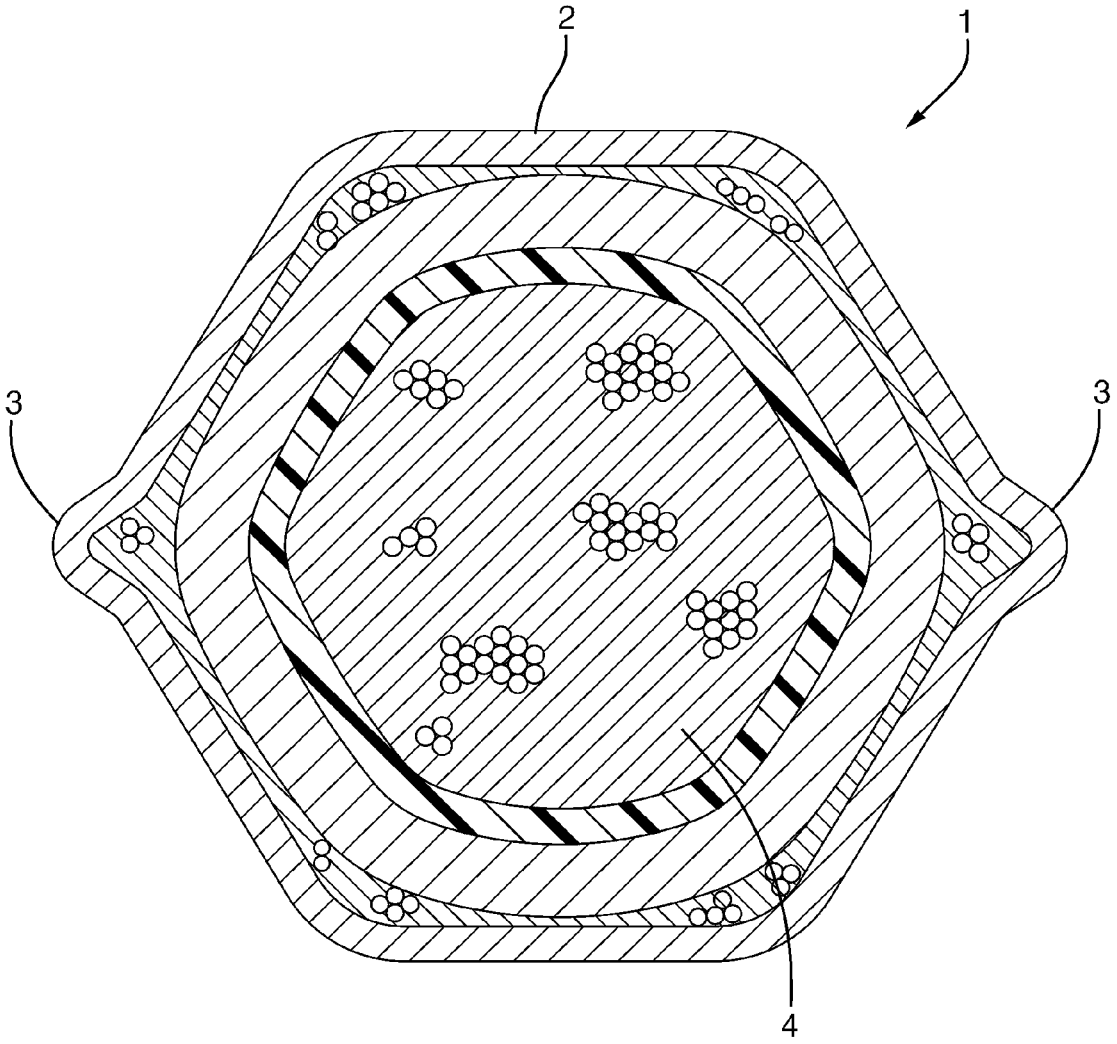
PRIOR ART FIG. 1
FIG. 1 shows a conventional hexagonal-shaped crimp that includes undesired protrusions that may broadcast undesired RF energy from the hexagonal-shaped crimp.

A robust wire cable assembly that contains a crimp connection that reduces undesired broadcast RF energy from the wire cable assembly has been presented. A crimp tool includes a pair of press halves that each include a pair of humps and a proboscis member to form the crimp connection in the wire cable assembly. When the tool halves come together to form the crimp connection, the tool is constructed so that the material of an outer ferrule of the wire cable assembly moves in a direction away from a seam of press tool so that the press tool forms the crimp connection in to a shape that keeps undesired protrusions from being formed as is the case for the hexagonal-shaped crimp previously described in the Background and as shown in prior art FIG. 1. The advantageous result is a more uniformly shaped crimp that does not broadcast or receive energy, more particularly RF energy such as may occur with coaxial cable-type wire cable assemblies. Additionally, a more robust, mechanical attachment of the wire braid to the ferrules as part of the crimp connection of the coaxial cable-type wire cable assembly is also realized. A crimp connection having a pair of humps separated by a groove therebetween may also be formed in an electrical contact which comprises a terminal that includes a base. The pair of humps and the groove are formed in the base of the terminal when the crimp connection is constructed so as to attach the terminal to the wire cable. A crimp connection containing at least a pair of humps with a groove disposed therebetween may be constructed on a wire cable assembly having a plurality of ferrules to ensure a robust electrical and mechanical connection.

While this invention has been described in terms of the preferred embodiment thereof, it is not intended to be so limited, but rather only to the extent set forth in the It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A wire cable assembly comprising:

a wire cable, wherein the wire cable includes an electrically-conductive inner core, a first insulation layer that surrounds the inner core, and an outer electrically-conductive wire layer that surrounds the first insulation layer; and an inner ferrule and an outer ferrule both having a longitudinal axis and received at an end of the wire cable and fitted proximate thereto in a manner so the outer electrically-conductive wire layer is disposed between the inner ferrule and the outer ferrule, wherein portions of both the inner ferrule and the outer ferrule are formed to define a pair of concave indentations consisting of a first concave arcuate indentation that diametrically opposes a second concave arcuate indentation, wherein both the inner ferrule and the outer ferrule are formed to define generally hexagonal shape having only four flat sides.

2. The wire cable assembly according to claim 1, wherein the first concave arcuate indentation and the second concave arcuate indentation are disposed in an inbound direction towards the longitudinal axis.

3. The wire cable assembly according to claim 1, wherein the wire cable assembly is disposed in a motorized vehicle.

4. The wire cable assembly according to claim 1, wherein the outer ferrule has an outer groove depth and the inner ferrule has an inner groove depth and the outer groove depth is greater than the inner groove depth.

5. The wire cable assembly according to claim 1, further comprising a contact element configured to axially receive the wire cable, wherein the contact element is formed to attach the wire cable to the contact element and wherein a portion of the contact element is formed to define the pair of concave arcuate indentations.

6. The wire cable assembly according to claim 5, wherein the pair of concave indentations of the contact element correspond to the pair of concave indentations of the outer ferrule and the inner ferrule.

7. The wire cable assembly according to claim 5, wherein a portion of the contact element is formed to define a generally hexagonal shape having the pair of concave indentations.

8. A method to form a crimp connection in a wire cable assembly, comprising:

providing a wire cable, an inner ferrule, and an outer ferrule, wherein the wire cable includes an electrically-conductive inner core, a first insulation layer that surrounds the inner core, and an outer electrically-conductive wire layer that surrounds the first insulation layer;

receiving a portion of the outer electrically-conductive wire layer between the inner ferrule and the outer ferrule; and crimping the wire cable the inner ferrule, and the outer ferrule together to form the crimp connection that attaches the inner ferrule and the outer ferrule to the wire cable in which at least a portion of the crimp connection is formed to define a pair of concave indentations consisting of a first concave arcuate indentation that diametrically opposes a second concave arcuate indentation, wherein both the inner ferrule and the outer ferrule are formed to define generally hexagonal shape having only four flat sides.

9. The method according to claim 8, wherein the providing step further includes:

providing a crimp tool used to form said pair of concave indentations in the crimping step, the crimp tool defining a plurality of flat sides and a pair of proboscis members that extends therebetween and wherein the pair of proboscis members of the crimp tool forms the pair of concave indentations.

10. The method according to claim 8, wherein the method further includes extruding material along the outer ferrule when the crimp connection is formed by a crimp tool in a direction away from a seam of the crimp connection so that one or more protrusions formed in said extruded material by the crimp tool do not form adjacent the seam.

11. The method according to claim 8, wherein the wire cable assembly is associated with a motorized vehicle.

* * * * *